US005174674A

United States Patent [19]

Norwood

[11] Patent Number: 5,174,674

[45] Date of Patent: Dec. 29, 1992

[54] SAMPLE BOOK

[75] Inventor: Robert K. Norwood, Edison, N.J.

[73] Assignee: Economy Color Card, Inc., Roselle, N.J.

[21] Appl. No.: 813,815

[22] Filed: Dec. 26, 1991

[51] Int. Cl.[5] ..... B42F 13/00

[52] U.S. Cl. ..... 402/73; 402/80 R; 402/502

[58] Field of Search ..... 402/72, 75, 80 R, 77, 402/70, 73, 502

[56] References Cited

U.S. PATENT DOCUMENTS

| | | | |
|---|---|---|---|
| 3,837,680 | 9/1974 | Cimini | 402/80 R |
| 4,907,904 | 3/1990 | Baldwin | 402/80 R |
| 4,943,177 | 7/1990 | Jordan et al. | 402/80 R |
| 5,066,158 | 11/1991 | Huang | 402/80 R |

FOREIGN PATENT DOCUMENTS

| | | | |
|---|---|---|---|
| 783401 | 4/1968 | Canada | 402/80 R |

*Primary Examiner*—Timothy V. Eley
*Assistant Examiner*—William Fridie, Jr.
*Attorney, Agent, or Firm*—Lerner, David, Littenberg, Krumholz & Mentlik

[57] ABSTRACT

A sample book for retaining a plurality of sample cards includes at least two retaining members for the sample cards disposed on opposite sides of a foldable spine. In the folded position of the spine, the retaining members are relatively close to one another, while in the unfolded position of the spine the retaining members are spaced from one another so that the sample cards can lie flatly therebetween.

16 Claims, 2 Drawing Sheets 100
10
20
40
12
14
14a
16
16a
18
19
22
24
26
27
28
29
30
31
32
33
35
36
37
39
42
44
46
48
102
104
106
108
110

SAMPLE BOOK

FIELD OF THE INVENTION

The present invention relates to a book for releasably retaining a plurality of leaves in assembled position and, more particularly, to a sample book which is specially suited to retaining samples of bulky items for unobstructed viewing.

BACKGROUND OF THE INVENTION

In the decorating industry, distributors of decorating items, such as carpeting, wall coverings, window treatments, etc., typically maintain samples of such items in books in which the samples are organized and presented for convenient viewing by a potential customer. Most often, the sample is mounted to a card which is releasably held in place in the book by a ring binder, the use of which facilitates the replacement of sample cards for discontinued products with sample cards for newly introduced products.

As a result of the plethora of styles, colors and patterns in which these products are available, these books are frequently filled with more sample cards than they were originally intended to hold. Consequently, such books become very difficult to manage. This is particularly true where the books contain bulky items, such as carpet and window treatment samples, which fill such sample books rapidly.

Several difficulties arise in connection with the overfilling of these sample books. Firstly, it is often necessary to first remove numerous sample cards from the ring binder in order to reach an obsolete sample card which is to be removed or to reach the proper position at which a new sample card is to be inserted. More importantly, when too many sample cards are retained by a single ring binder, the cards will not lie flatly as progressive cards are turned for viewing by a customer.

Attempts have been made in the prior art to design books which will overcome these difficulties. Once such device, disclosed in U.S. Pat. No. 1,414,758 to Stavenagen, employs two ring binders connected at opposite edges of a book structure having a rectangular cross-section so as to use the space within the book most efficiently. Such configuration is impractical for use in sample books containing bulky samples since the cards having such samples do not assume the triangular cross-section typical of books having conventional pages. In another such device, shown in U.S. Pat. No. 4,943,177 to Jordan et al, a plurality of ring binders are assembled adjacent one another on the spine portion of an exhibit book. In such structure, however, the proximity of the ring binders to one another does not permit the pages held by any one ring binder to lie flatly, thereby making it more difficult to view the specimens on these pages.

In U.S. Pat. No. 4,180,341 to Langhorst, the patentee discloses a hinged binder assembly specifically directed to retaining and displaying samples of bulky items mounted on sample cards. Each sample card is retained by a generally rectangular rail member which can slide relative to the other rail members so that the sample cards can be stepped relative to one another and all of the samples can be viewed at one time. Not only is this hinged assembly costly to manufacture due to its complexity, but it only holds a fixed number of sample cards since each sample card must have its own rail member.

There therefore exists a need for a sample book which is capable of releasably holding a plurality of sample cards, and particularly cards having bulky samples, and which will permit the cards to lie flatly for viewing when the book is opened. Preferably, such sample book will form a compact unit when in a closed position, and will therefore be easily transported and used.

SUMMARY OF THE INVENTION

These needs have now been addressed by the invention of a book for releasably retaining a plurality of leaves in assembled position. In accordance with one aspect hereof, the book consists of a shell including a first panel hingedly connected to a first intermediate member for movement about a first axis, a second panel hingedly connected to a second intermediate member for movement about a second axis, the first and second intermediate members hingedly connected to one another for movement about a third axis between a contracted position and an expanded position, the first, second and third axes being parallel with one another, and at least two retaining members connected to the shell so that the retaining members are spaced apart by a first distance when the intermediate members are in the contracted position and the retaining members are spaced apart by a second distance greater than the first distance when the intermediate members are in the expanded position.

In accordance with one embodiment, the book further includes engagement means for releasably engaging the first and second intermediate members in the contracted position.

In yet another embodiment, the book further includes a front cover hingedly connected at one end to the first panel for movement about a fourth axis and having a free end, and a back cover hingedly connected at one end to the second panel for movement about a fifth axis and having a free end, the fourth and fifth axes being parallel to the first, second and third axes. In preferred embodiments, at least one of the retaining members is connected to one of the front and back covers. In still more preferred embodiments, the book further includes a closure member having one end connected to the free end of one of the front and back covers and another end opposite the one end releasably connected to the free end of the other one of the front and back covers.

Another aspect of the present invention provides a book assembly consisting of a shell including a first panel hingedly connected to a first intermediate member for movement about a first axis, a second panel hingedly connected to a second intermediate member for movement about a second axis, the first and second intermediate members hingedly connected to one another for movement about a third axis between a contracted position and an expanded position, the first, second and third axes being parallel with one another, at least two retaining members connected to the shell so that the retaining members are spaced apart by a first distance when the intermediate members are in the contracted position and the retaining members are spaced apart by a second distance greater than the first distance when the intermediate members are in the expanded position, and a plurality of leaves releasably retained by the at least two retaining members.

In one embodiment hereof, the book assembly further includes engagement means for releasably engaging the first and second intermediate members in the contracted position.

In yet another embodiment of the book assembly, each of the leaves has a width defined between a retained edge and a free edge, and the second distance is not less than the width of the leaves. In more preferred embodiments, the second distance is not less than two times the width of the leaves.

In still another embodiment, the book assembly further includes a front cover hingedly connected at one end to the first panel for movement about a fourth axis and having a free end, and a back cover hingedly connected at one end to the second panel for movement about a fifth axis and having a free end, the fourth and fifth axes being parallel to the first, second and third axes. In preferred embodiments, at least one of the retaining members is connected to one of the front and back covers. In still more preferred embodiments, the book assembly further includes a closure member having one end connected to the free end of one of the front and back covers and another end opposite the one end releasably connected to the free end of the other one of the front and back covers.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
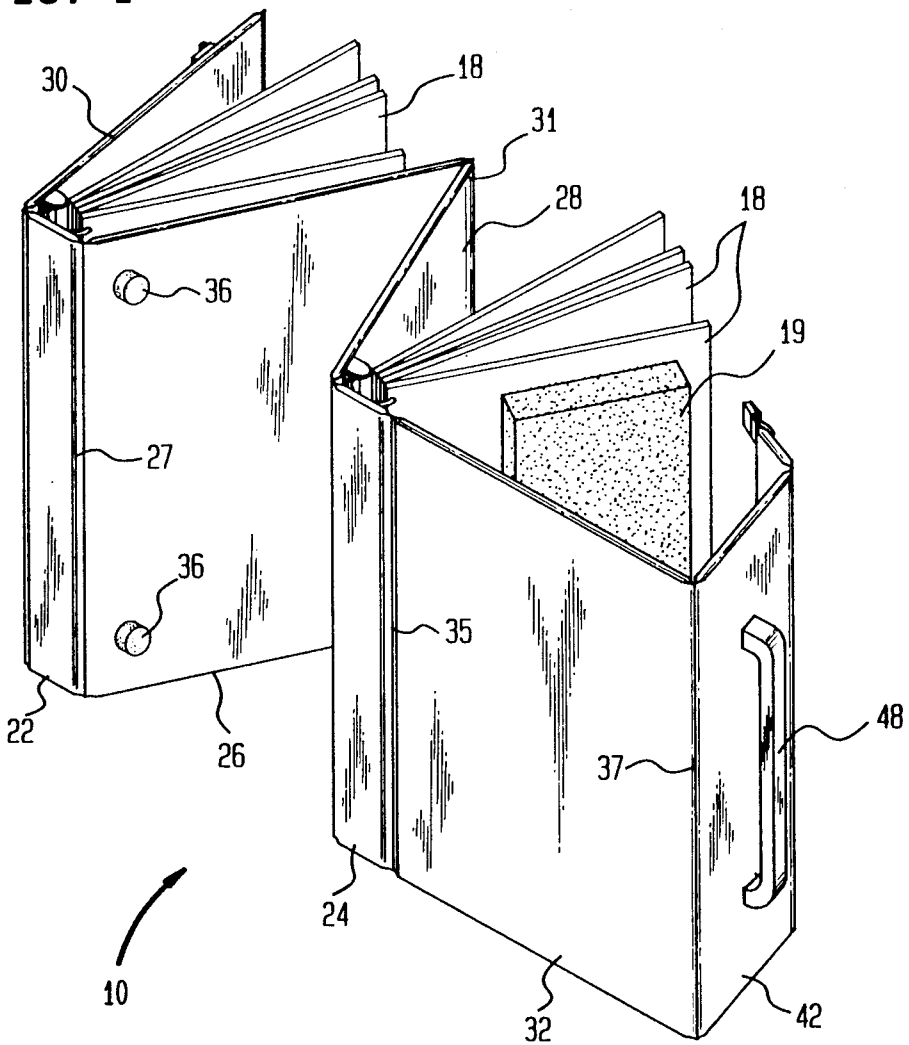
FIG. 1 is a perspective view of a sample book, in accordance with the present invention.
Figures 2, 3, 4:
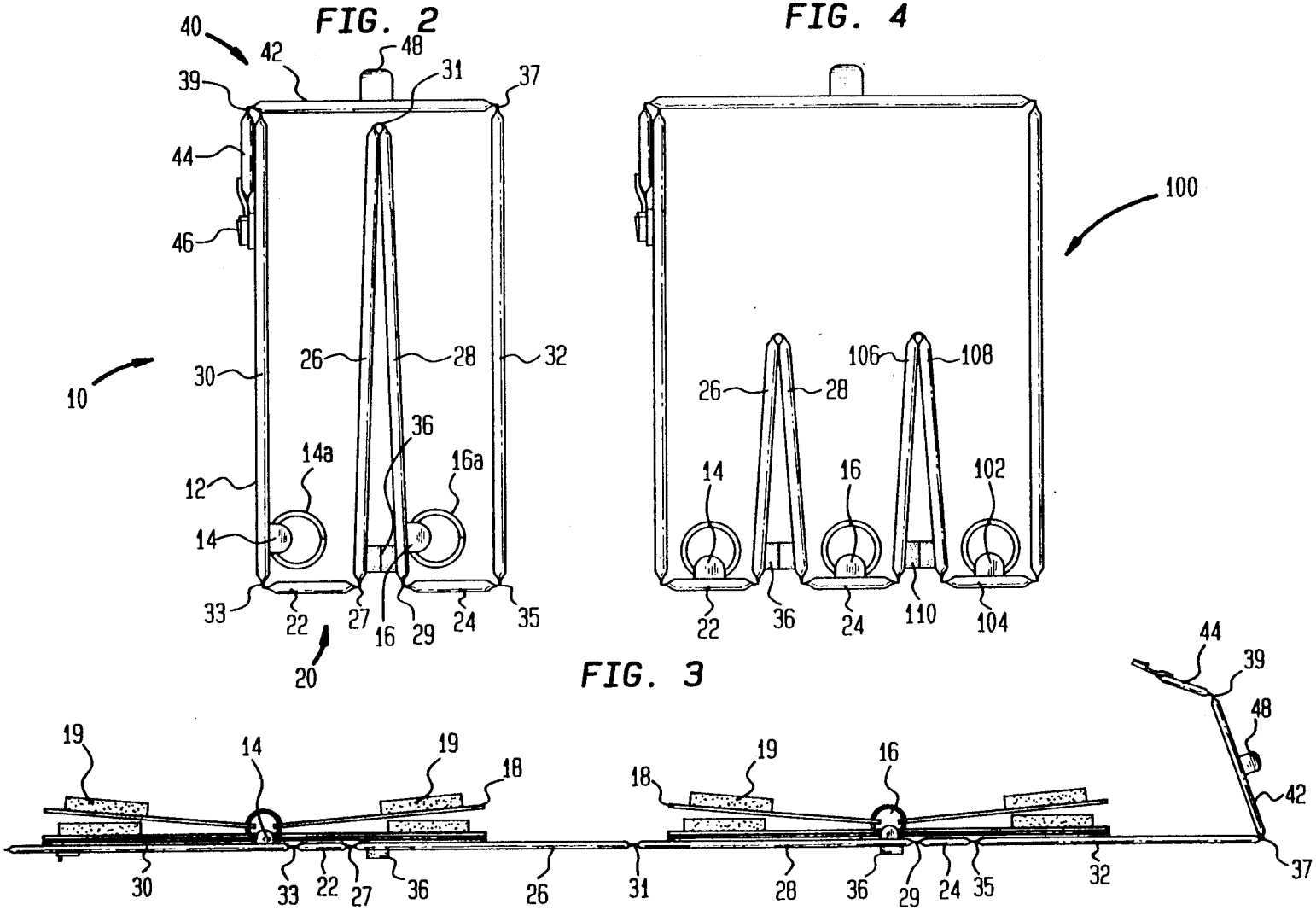
FIG. 2 is a side elevational view of the sample book of FIG. 1, shown in the closed position and with the sample cards removed.
FIG. 3 is a side elevational view of the sample book of FIG. 1, shown in the fully opened position.
FIG. 4 is a side elevational view of an alternate embodiment of a sample book in accordance with the present invention.

Referring to FIGS. 1-3, there is illustrated a sample book 10 in accordance with the present invention. Sample book 10 consists of a shell 12 and at least two retaining members 14 and 16 connected to the shell for holding a plurality of cards 18 in place therein. Each of cards 18 typically will have fixed thereto one or more samples of design items 19, such as carpeting, wall coverings, window treatments and the like.

The shell 12 includes a spine assembly, indicated generally at 20, having a first rigid spine member 22 and a second rigid spine member 24. A generally planar rigid panel 26 is connected along one edge to spine member 22 for pivotal movement about axis 27. Similarly, one edge of another generally planar rigid panel 28 connects to spine member 24 for movement about pivot axis 29. Panels 26 and 28 are pivotally connected to one another along their opposite edges for movement about axis 31. The width dimension of panels 26 and 28 will typically be substantially the same between their edges connected to spine members 22 and 24, respectively, and their edges connected to one another.

Shell 12 may further include a generally planar front cover 30 connected to spine member 22 for pivotal movement about axis 33. A similar generally planar back cover 32 may be pivotally connected to spine member 24 for movement about axis 35. As will be clear from the description which follows, shell 12 is formed so that axes 27, 29, 31, 33 and 35 are oriented parallel to one another. In addition, each of members 22, 24, 26, 28, 30 and 32 typically are formed from a rigid lightweight material such as cardboard, wood, aluminum and the like, and are pivotally connected to one another as described above by a web of a plastic or fabric material covering these members. Alternatively, these pivotal connections may be made by connecting a conventional hinge, such a piano hinge, between each of the respective members.

As illustrated in the figures, retaining members 14 and 16 comprise conventional ring binders having separable ring sets **14*a* and 16*a* which may be moved from an open position for inserting or removing the perforated sample cards 18 to a closed position for retaining these cards. It will be appreciated, however, that retaining members 14 and 16 may comprise any type of retaining member which can suitably be employed to releasably retain the sample cards 18 in the sample book. Depending on the type of retaining members employed, sample cards 18** may or may not be provided with perforations for cooperating with these retaining members.

Referring to FIG. 2, sample book 10 is shown in a closed position in which it is folded into a compact unit which can be readily transported or stored. In this position, spine members 22 and 24 are located adjacent to one another with planar members 26 and 28 in opposed relationship. Spine members 22 and 24 are held in this position by releasable fastening members 36, one portion of which is fixedly connected to planar member 26 and the other portion of which is fixedly connected to planar member 28. Fastening members 36 may include any conventional type of releasable fastener, such as magnets, snaps, VELCRO, etc.

A closure assembly, indicated generally at 40, may optionally be provided for enclosing the open side of sample book 10 opposite spine members 22 and 24. Not only does closure assembly 40 protect the free ends of sample cards 18 from damage, but it may also hold front and back covers 30 and 32 in the closed position. Closure assembly 40 is preferably formed from the same materials as members 22-32, and includes a first planar member 42 pivotally connected to the free edge of back cover 32 for movement about axis 37. Member 42 extends across the open side of sample book 10 to front cover 30, where it connects to planar member 44 which may move pivotally about axis 39. Preferably, axes 37 and 39 are oriented parallel to axes 27-35. A releasable fastener 46 connects planar member 44 to front cover 30 to retain closure assembly 40 in this closed position. Fastener 46 may be in the form of a conventional slidable fastener as shown, or may comprise any other conventional type of releasable fastener, such as VELCRO, snaps, magnets, etc. A handle 48 secured to member 42 facilitates carrying sample book 10 from place to place.

When it is desired to view the samples 19 in sample book 10, fastener 46 is unfastened and closure member 40 is opened by pivoting about axis 37. Spine members 22 and 24 are then pulled in opposite directions away from one another to release the opposed portions of fastening members 36 and to move shell 12 toward the fully opened position shown in FIG. 3. During this unfolding movement, axes 27-35 will remain substantially parallel with one another while a first set of axes 27 and 33 is displaced relative to a second set of axes 29 and 35, both sets of axes being displaced relative to axis 31. This action results in a corresponding movement of retaining members 14 and 16 away from one another until shell 12 reaches its fully opened position, at which time retaining members 14 and 16 will be separated by a predetermined distance. This distance will be determined, firstly, by the width of planar member 26 between axes 27 and 31 and the width of planar member 28 between axes 29 and 31 and, secondly, by the position at which retaining members 14 and 16 are connected to shell 12. Thus, for example, by forming planar members 26 and 28 with a width that is substantially similar to the width of sample cards 18, an ample space will be provided between retaining members 14 and 16 so that the sample cards 18 held by both will be able to lie flatly between these retaining members simultaneously, all of which is shown in FIG. 3. This would be the case even were the predetermined distance between retaining members 14 and 16 shortened by connecting retaining member 14 to planar member 26 adjacent spine member 22, rather than to front cover 30 as shown.

Obviously, even were planar members 26 and 28 to have a smaller width than that of sample cards 18, a sufficient predetermined distance could be provided between retaining members 14 and 16 to enable the sample cards on both of these members to lie flatly therebetween simultaneously without interfering with the other member merely by connecting retaining members 14 and 16 to suitable portions of shell 12. That is, when retaining member 14 is connected to planar member 26 adjacent spine member 22 and retaining member 16 is connected to planar member 28 adjacent spine member 24, planar members 26 and 28 both must have a width which is substantially equal to the width of sample cards 18 for the sample cards on both of retaining members 14 and 16 to lie flatly between these retaining members simultaneously. However, as the connections of retaining members 14 and 16 to shell 12 are moved respectively away from one another, the width of planar members 26 and 28 may be reduced without changing the result. Thus, the width of planar members 26 and 28 may be reduced by equal first amounts by connecting retaining member 14 to spine member 22 rather than planar member 26; by a further amount by connecting retaining member 16 to spine member 24 rather than planar member 28; still further by connecting retaining member 14 to front cover 30 rather than spine member 22; and further yet by connecting retaining member 16 to back cover 32 rather than spine member 24.

The width of planar members 26 and 28 can also be dimensioned so that only the sample cards 18 on one of retaining members 14 and 16 will be able to lie flatly between these members at a time without interfering with the other member. An example of this is illustrated in the embodiment shown in FIG. 4. In this embodiment, a sample book 100, having substantially the same construction as sample book 10 described above, includes a third retaining member 102 in addition to retaining members 14 and 16. Accordingly, spine assembly 20 will include three rigid spine members 22, 24 and 104, adjacent ones of which will be separated by a pair of opposable planar members. Retaining members 14 and 16 again will have planar members 26 and 28 pivotally connected therebetween as described above, while retaining members 16 and 102 will have planar members 106 and 108 pivotally connected therebetween in similar fashion. Again, one or more releasable fasteners 36 may be employed to hold planar members 26 and 28 in opposed relationship, while one or more similar releasable fasteners 110 may be used for the same purpose between planar members 106 and 108.

Sample book 100 is opened and operated in substantially the same way as described above in connection with sample book 10. However, since releasable fasteners 36 and 110 may be operated independently, sample book 100 need not be unfolded to its fully open position when it is not necessary to do so. Thus, for example, if it is desired to view only those sample cards 18 on retaining member 102, spine members 24 and 104 may be pulled in opposite directions away from one another to release the opposed portions of fastening members 110 and place planar members 106 and 108 in their fully unfolded position, while maintaining planar members 26 and 28 in opposed relationship and the opposed portions of fasteners 36 fastened. This will provide ample space between retaining members 16 and 102 so that sample cards 18 on retaining member 102 can lie flatly without interfering with retaining member 16. Of course, if it is desired to view only the sample cards on retaining member 14, planar members 26 and 28 can be unfolded as described above without unfastening releasable fasteners 110.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

I claim:

1. A book for releasably retaining a plurality of leaves in assembled position, comprising a shell including a first panel hingedly connected to a first intermediate member for movement about a first axis, a second panel hingedly connected to a second intermediate member for movement about a second axis, said first and second intermediate members hingedly connected to one another for movement about a third axis between a contracted position and an expanded position, said first, second and third axes being parallel with one another, and retaining means for retaining at least one article in fixed relationship with respect to said shell, said retaining means including at least two retaining members connected to said shell so that said retaining members are spaced apart by a first distance when said intermediate members are in said contracted position and said retaining members are spaced apart by a second distance greater than said first distance when said intermediate members are in said expanded position.

2. The book as claimed in claim 1, further comprising engagement means connected to said shell for holding said intermediate members in said contracted position when said engagement means is in an engaged condition and for permitting movement of said intermediate members to said expanded position when said engagement means is a disengaged condition.

3. The book as claimed in claim 1, wherein at least one of said retaining members is connected to said first panel.

4. The book as claimed in claim 1, wherein at least one of said retaining members is connected to said first intermediate member.

5. The book as claimed in claim 1, further comprising a front cover hingedly connected at one end to said first panel for movement about a fourth axis and having a free end, and a back cover hingedly connected at one end to said second panel for movement about a fifth axis and having a free end, said fourth and fifth axes being parallel to said first, second and third axes.

6. The book as claimed in claim 5, wherein at least one of said retaining members is connected to one of said front and back covers.

7. The book as claimed in claim 5, further comprising a closure member having a first end connected to said free end of one of said front and back covers and having a second end opposite said first end releasably connected to said free end of the other one of said front and back covers.

8. A book assembly, comprising a shell including a first panel hingedly connected to a first intermediate member for movement about a first axis, a second panel hingedly connected to a second intermediate member for movement about a second axis, said first and second intermediate members hingedly connected to one another for movement about a third axis between a contracted position and an expanded position, said first, second and third axes being parallel with one another, retaining means for retaining at least one article in fixed relationship with respect to said shell, said retaining means including at least two retaining members connected to said shell so that said retaining members are spaced apart by a first distance when said intermediate members are in said contracted position and said retaining members are spaced apart by a second distance greater than said first distance when said intermediate members are in said expanded position, and a plurality of leaves releasably retained by said at least two retaining members.

9. The book assembly as claimed in claim 8, further comprising engagement means connected to said shell for holding said intermediate members in said contracted position when said engagement means is in an engaged condition and for permitting movement of said intermediate members to said expanded position when said engagement means is in a disengaged condition.

10. The book assembly as claimed in claim 8, wherein at least one of said retaining members is connected to said first panel.

11. The book assembly as claimed in claim 8, wherein at least one of said retaining members is connected to said first intermediate member.

12. The book assembly as claimed in claim 8, wherein each of said leaves has a width defined between a retained edge and a free edge, and wherein said second distance is not less than said width.

13. The book assembly as claimed in claim 12, wherein said second distance is not less than two times said width.

14. The book assembly as claimed in claim 8, further comprising a front cover hingedly connected at one end to said first panel for movement about a fourth axis and having a free end, and a back cover hingedly connected at one end to said second panel for movement about a fifth axis and having a free end, said fourth and fifth axes being parallel to said first, second and third axes.

15. The book assembly as claimed in claim 14, wherein at least one of said retaining members is connected to one of said front and back covers.

16. The book assembly as claimed in claim 14, further comprising a closure member having a first end connected to said free end of one of said front and back covers and having a second end opposite said first end releasably connected to said free end of the other one of said front and back covers.

* * * * *